United States Patent [19]

Mueschke

[11] 4,414,769

[45] Nov. 15, 1983

[54] AMBIDEXTROUS SAFETY FOR GUNS

[76] Inventor: Herman W. Mueschke, 1003 Columbia St., Houston, Tex. 77008

[21] Appl. No.: 228,541

[22] Filed: Jan. 26, 1981

[51] Int. Cl.[3] ..... F41C 17/00

[52] U.S. Cl. ..... 42/70 R

[58] Field of Search ..... 42/70 R, 70 C, 70 D, 42/70 E, 70 F

[56] References Cited

U.S. PATENT DOCUMENTS

| | | | |
|---|---|---|---|
| 1,355,423 | 10/1920 | Pedersen | 89/196 X |
| 1,896,820 | 2/1933 | Jolidon | 89/148 |
| 3,492,748 | 2/1970 | Swenson | 42/70 R |
| 4,282,795 | 8/1981 | Beretta | 42/70 F |

FOREIGN PATENT DOCUMENTS

| | | | |
|---|---|---|---|
| 2731893 | 2/1978 | Fed. Rep. of Germany | 42/70 F |

*Primary Examiner*—Charles T. Jordan
*Assistant Examiner*—Ted L. Parr
*Attorney, Agent, or Firm*—Gunn, Lee & Jackson

[57] ABSTRACT

An ambidextrous safety system for guns wherein such guns are adapted for efficient use by right or left-handed users. The safety system is adapted particularly for handguns, such as the Colt 0.45 caliber semi-automatic handgun, for example, but it is also quite well adapted for other types of guns as well. Manually actuated safety devices are positioned on each side of the frame of the gun and are adapted to be moved between safe and firing position. A pair of pivot pins, connected to each of the safety devices, extend through apertures in the frame of the gun and are nonrotatably connected by means of a mechanical interlock. The mechanical interlock is located within a close fitting bore of the frame, thus providing a structural stability therefor. A sear pin also extends through registering apertures in the frame by one of the safety devices. The other safety device establishes a movable interlocked relationship with the opposite extremity of the sear pin, thus causing the other safety device to be maintained in movable assembly with the frame of the gun by the sear pin. The safety devices may include an extended manually engaging portion, allowing the user to readily manipulate the safety with the thumb of the gun supporting hand without material change in the position of the gun supporting hand.

18 Claims, 9 Drawing Figures

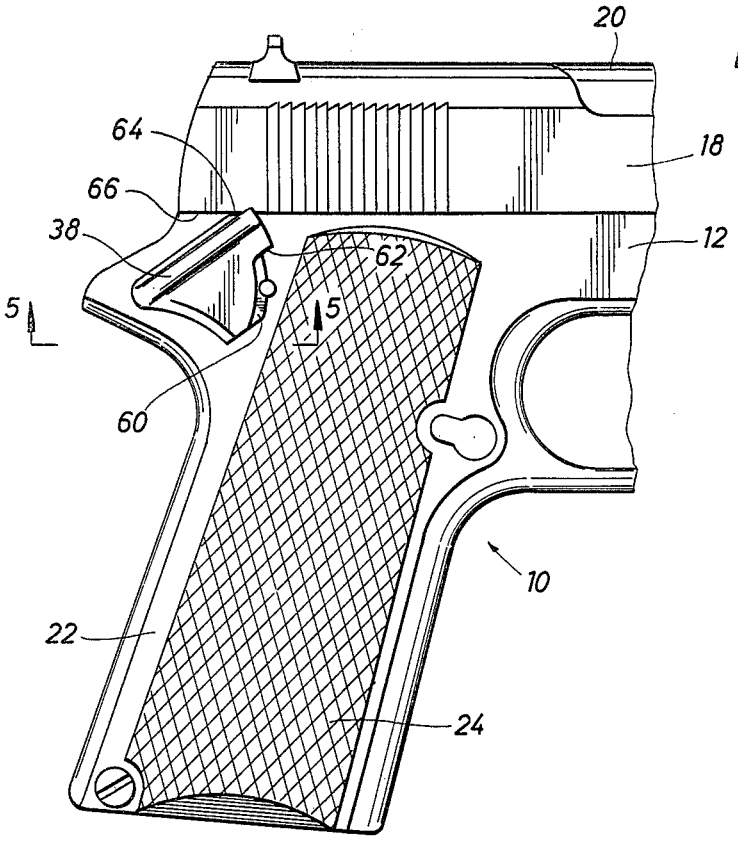
FIG. 1
FIG. 2
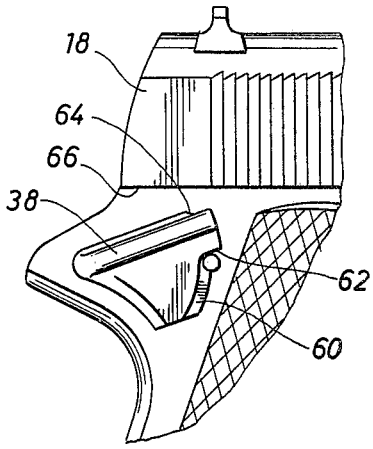
FIG. 4
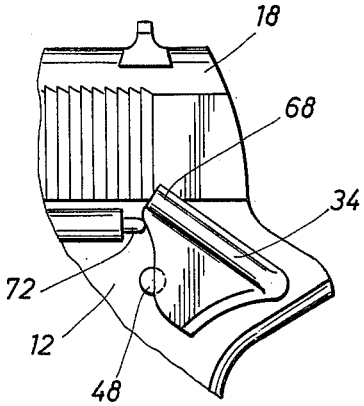
FIG. 3
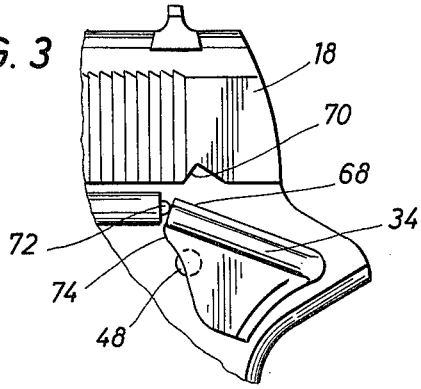
FIG. 5
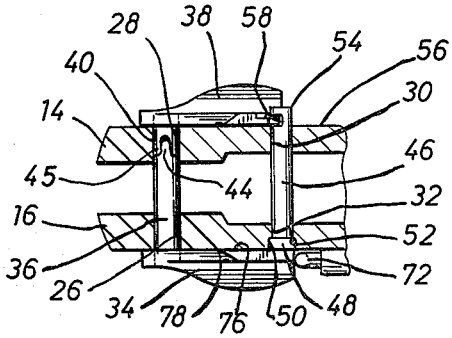

AMBIDEXTROUS SAFETY FOR GUNS

FIELD OF THE INVENTION

This invention relates generally to guns such as handguns, rifles, shotguns, etc. and, more particularly, relates to an ambidextrous safety system for such guns, enabling them to be efficiently utilized by both right-handed and left-handed users. Even more specifically, the present invention includes a safety system that may replace the safety system for existing guns, thereby converting such guns from a safety system primarily designed for right-handed users to a safety system that may be utilized by both right-handed users and left-handed users.

BACKGROUND OF THE INVENTION

Virtually all guns, whether handguns, rifles, shotguns, etc., have historically been manufactured for use primarily by right-handed users for the simple reason that right-handed users vastly outnumber left-handed users. Many manufacturers are now beginning to manufacture guns that may be efficiently used by left-handed users as well as right-handed users. An extremely large number of guns exist, however, that can be efficiently utilized only by right-handed users, and it is desirable to provide means for modifying the safety systems thereof to facilitate use of these guns by left-handed users as well.

One good example of a handgun that can be utilized efficiently only by right-handed users is the Government Model semi-automatic handgun that is presently manufactured by Colt's Patented Fire Arms Manufacturing Company of Hartford, Conn., herein referred to as "Colt," and which has been manufactured by Colt for approximately sixty years. This handgun has gained wide commercial acceptance for use in sport shooting, military and law enforcement, especially where right-handed users are concerned. The safety system for the Colt Government Model semi-automatic handgun is a thumb actuated safety that is located immediately above the grip portion of the pistol frame and which is typically pivoted to a safe position by the right thumb of a right-handed user. A portion of the safety engages within a recess or detent formed in the slide portion of the gun and is movable also to a firing position where it is clear of the slide detent. A right-handed user simply manipulates the safety by pressing on the upper portion of the safety with the thumb of the right hand to move the safety from its safe position to the firing position. It may also be moved from the safe position to the firing position by pivoting it upwardly with the thumb of the right hand to engage the safety device in the slide recess. A left-handed user, however, typically manipulates the safety device of the Colt semi-automatic handgun by reaching over the slide of the gun with the right hand and moving the safety device to the desired position. This is, of course, an awkward and undesirable movement for left-handed users that sometimes limits acceptability of the gun for left-handed users. Moreover, where such guns are employed by officers involved in law enforcement or military personnel, the time required for manipulation of this safety by a left-handed user could be disadvantageous to the officer from the standpoint of safety. It is therefore desirable to provide such guns with safety devices that can be simply and efficiently manipulated by both right-handed and left-handed users without requiring additional effort or awkward movements to accomplish such manipulation. It may also be desirable to ensure that the user be able to move the safety device to the firing position and fire the gun with one hand.

The discussion herein pertains particularly to the Government Model semi-automatic hand gun manufactured by Colt for purposes of simplicity and understanding, but it is not intended by such discussion to limit the present invention to handguns or to guns manufactured by any particular manufacturer.

Ambidextrous safety devices have been developed by a number of manufacturers as original equipment on guns, especially rifles and shotguns. In some cases, ambidextrous safety devices are also employed as original equipment on handguns. In the case of the 0.45 caliber semi-automatic handgun manufactured by Colt, one manufacturer has developed an ambidextrous safety system which is identified in U.S. Pat. No. 3,492,748 and which is sold commercially and which adapts this particular handgun for use by left-handed users as well as right-handed users. This particular safety system replacement requires modification of the handgun, especially the grip portion thereof, in order to provide means for retaining the safety system in assembly with the handgun.

Modification of the grip portion of the handgun is not satisfactory for a number of reasons. Where the grip is composed of wood, a portion of the wood must be cut away to provide a receiver for the tang portion of the safety device. This is an expensive procedure because considerable care must be exercised to ensure that the recess that is cut in the grip is accurately dimensioned. Additionally, the wood or other material of the grip is utilized as a stop for positioning the safety device. Should the wood yield through continued use, the safety device would not be stopped at the proper position and the safety system would be adversely affected. Moreover, a recess into which the tang portion of the safety device is received can become partially filled with dirt and other debris through extended use and the dirt and debris can interfere with proper positioning of the safety device. It is considered desirable therefore to provide a safety conversion system for guns that may be simply and efficiently assembled to the gun without requiring modification of the gun itself. Moreover, it is desirable to provide an ambidextrous safety system that may be assembled to a gun in a few minutes time by inexperienced personnel through the use of simple tools.

The thumb actuated safety of the Colt semi-automatic handgun described above and other similar handguns can be operated by the thumb of the user only by substantial shifting of the grip of the user. In law enforcement and military use of the gun, it is desirable to have the capability of operating the thumb safety with the hand of the user in substantially proper gripping relation with the gun.

It is a primary feature of the present invention, therefore, to provide a novel ambidextrous safety system for guns that may be utilized as a replacement for conventional safety devices which are designed primarily for use by right-handed users.

It is also a feature of the present invention to provide a novel ambidextrous safety system for guns that enables such guns to be utilized by both right-handed and left-handed users without requiring any awkward or time consuming movements for such manipulation.

Among the several features of the present invention is noted the contemplation of a novel ambidextrous safety system for guns that is a replacement for the conventional right-handed safety thereof and which may be simply and efficiently assembled to the guns without requiring any modification thereof.

It is a further feature of the present invention to provide a novel ambidextrous safety system for guns wherein both right-handed and left-handed safety devices are interlocked in such manner as to move simultaneously.

It is also a feature of this invention to provide a safety for handguns of the character described wherein the safety is provided with a thumb engaging position that is so positioned as to facilitate operation by the user's hand substantially in proper gripping relation with the handgun.

It is an even further feature of the present invention to provide a novel ambidextrous safety system for guns wherein a sear pin may be incorporated into the handgun system in such manner as to be retained in assembly with the handgun frame by one of the safety devices and be mechanically interlocked with the opposite safety device in such manner as to retain the opposite safety device in movable assembly with the handgun frame.

It is also a feature of the present invention to provide a novel ambidextrous safety system for guns that may be sold in kit form to be assembled to the handgun structure by the user without necessitating the use of special tools or equipment and without modification of the gun structure other than simple replacement of parts.

It is also an important feature of the present invention to provide a novel ambidextrous safety system for guns that is of simple nature, is reliable in use and low in cost.

Other and further objects, advantages and features of the present invention will become apparent to one skilled in the art upon consideration of the written specification, the attached claims and the annexed drawings. The form of the invention, which will now be described in detail, illustrates the general principles of the invention, but it is to be understood that this detailed description is not to be taken as limiting the scope of the present invention.

SUMMARY OF THE INVENTION

A preferred embodiment of the present invention may comprise a pair of movable safety devices, one being a right-handed safety device and the other being a left-handed safety device. In the case of a handgun where the safety devices are intended to be manipulated by the thumb of the user, the right-handed safety device is located on the left-hand side of the frame immediately above the grip portion of the gun. The left-handed safety device conversely is located on the right side of the frame immediately above the grip portion. A pair of safety pivot shafts extend from each of the right and left-handed safety devices through registering apertures formed in the frame of the gun. One of the shafts is formed to define a male connector while the other shaft defines a female connector. The male and female connectors interlock in such manner as to lock the shafts in nonrotatable relation, thereby providing drive means to cause simultaneous movement of both safety devices when one of the safety devices is manipulated. This feature provides for use of the gun in simple and efficient manner by both right-handed and left-handed users and ensures that the gun can be unlocked and fired with one hand by both right and left-handed users. Mechanical support is provided for the interlock by positioning the male and female interlocking portions of the connector pins within a bore of the handgun frame that closely fits the connector pin.

The invention also includes a sear pin that extends through registering apertures in the frame of the gun and which provides the usual sear pin function. The sear pin incorporates an enlarged head that is received within a sear pin head recess formed in the frame of the gun that defines a shoulder to limit movement of the sear pin in one direction. One of the safety devices overlies the head portion of the sear pin and thus functions to retain the sear pin against inadvertent disassembly from the frame of the gun. The opposite extremity of the sear pin extends slightly beyond the frame of the gun and is formed to define a sear pin groove that is also positioned outwardly of the frame. One of the safety devices is formed to define an arcuate flange that is received by the sear pin groove in such manner that an interlocked relationship is established between the sear pin and the safety device which prevents the safety device from becoming inadvertently disassembled from the frame structure of the gun. The interlocked relationship between the safety device and the sear pin is maintained at all positions of the safety device. The safety of handguns for right-handed users, left-handed users or both may incorporate an extended portion that is capable of being contacted by the thumb of the user with the hand in substantially proper gripping relation with the handgun, thus facilitating more efficient and more rapid operation of the safety.

BRIEF DESCRIPTION OF THE DRAWINGS

So that the manner in which the above-received features, advantages and objects of the present invention, as well as others which will become apparent, are attained and can be understood in detail, more particular description of the invention, briefly summarized above, may be had by reference to the embodiment thereof which is illustrated in the appended drawings, which drawings form a part of this specification.

It is to be noted, however, that the appended drawings illustrate only typical embodiments of the invention and are therefore not to be considered limiting of its scope, for the invention may admit to other equally effective embodiments.

In the drawings:

FIG. 1 is a partial elevational view of a Colt semi-automatic handgun of conventional nature, such as is manufactured by Colt, the safety device of which has been replaced by the ambidextrous safety system of the present invention, FIG. 1 showing the left-handed safety device in the safe position thereof.

FIG. 2 is a fragmentary, elevational view of the handgun structure shown in FIG. 1 with the left-handed safety device of the present invention illustrated in the unlocked or firing position thereof.

FIG. 3 is a fragmentary elevational view of the opposite side of the handgun illustrated in FIG. 1 showing the right-handed safety device of the present invention in the firing or unlocked position thereof.

FIG. 4 is a fragmentary elevational view of the handgun structure of FIG. 1 showing the right-handed safety device of the present invention in the locked or safe position thereof.

FIG. 5 is a partial sectional view of the handgun structure of FIG. 1 taken along line 5-5 of FIG. 1 and showing the connector pins sear pin and the relationships of the right and left-handed safety devices to the pin and to the frame of the gun structure.

FIG. 6 is a fragmentary sectional view of the structure of FIG. 5, illustrating the shaft coupling and support mechanism in detail.

FIG. 7 is a partial plan view of a handgun safety representing an alternative embodiment of this invention.

FIG. 8 is a partial side view of a handgun showing the safety of FIG. 7 in assembly therewith.

FIG. 9 is a plan view of a left-handed and right-handed safety mechanism with the shafts thereof being coupled, the safety mechanism representing an alternative embodiment incorporating the features of FIGS. 7 and 8.

DETAILED DESCRIPTION OF PREFERRED EMBODIMENTS

Figure 8:
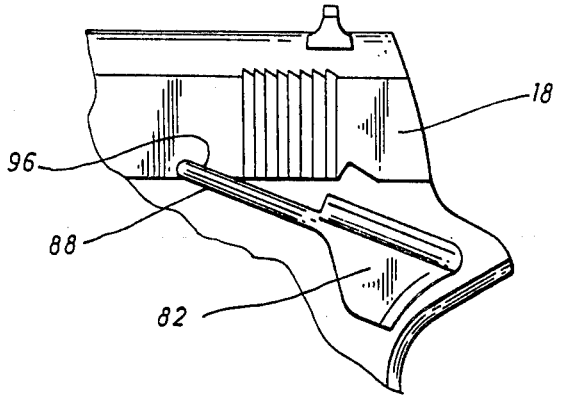

Referring now to the drawings and first to FIG. 1, there is shown a handgun structure generally at 10 which is of a design manufactured and sold by Colt. The most popular handgun of this type is sold by Colt as the 0.45 caliber semi-automatic handgun, also referred to as the Colt Government Model. The handgun structure comprises a frame 12 which is machined in such manner as to define frame side portions 14 and 16 which are shown in section in FIG. 5. The handgun structure also includes a slide portion 18 that is spring biased to the position shown in FIG. 1 and which is driven rearwardly or to the left by gas energy developed during the burning of gun powder. As the slide 18 moves rearwardly, a hammer, not shown, is also driven rearwardly and is locked in its firing position. After the slide 18 has been returned to the position shown in FIG. 1 by the slide spring, the gun may be fired again simply by applying sufficient digital force to the trigger to release the sear, thus causing release of the cocked trigger. Ejection of spent cartridges through a cartridge ejection opening 20 also occurs as the slide 18 is moved rearwardly by the expanding gas of the burning gun powder.

The frame portion 12 of the handgun also defines a handle or grip portion 22 to which is connected a pair of grip element 24 that make the user's grasp on the handgun more secure during use. The handle portion 22 is adapted to receive a cartridge loaded magazine that is designed to position cartridges to be picked up and delivered into the firing chamber of the gun as the slide 18 moves forward under the influence of the slide spring after having been fired.

The safety system of the handgun shown in FIG. 1 typically includes a thumb manipulated safety device on the exterior portion of the handgun that connects to internal apparatus and prevents movement of the sear to the hammer release position.

Referring now to FIG. 5, the frame of the handgun shown in FIG. 1 is formed to define a pair of registering apertures or short bores 26 and 28 that conventionally receive the pivot pin of the right-handed safety device with which such handguns are provided. The frame structure is also formed to define a pair of registering apertures 30 and 32 that conventionally receive a sear element that functions to lock the hammer against movement to the firing position. Only when the safety is off or in the firing position will the trigger mechanism be allowed to move the sear to the hammer releasing position. For purposes of simplicity, the sear and the hammer pin are not shown in the drawings.

Referring again to FIG. 5, the present invention includes a right-handed safety element 34 that is maintained in pivotal assembly with the frame 12 by means of a shaft 36 that extends through the aperture or bore 26 with the free extremity thereof positioned within the bore or aperture 28. The present invention also includes a left-handed safety element 38 that is maintained in pivotal connection with the frame 12 of the handgun by means of a stub shaft 40 that is positioned within the aperture or bore 28. The shaft 36 is provided with a male connection 44 that is received by a female connection element 42 formed on shaft 40 to provide a nonrotatable relationship between shafts 36 and 40 when the shafts are maintained in assembly.

Figure 6:
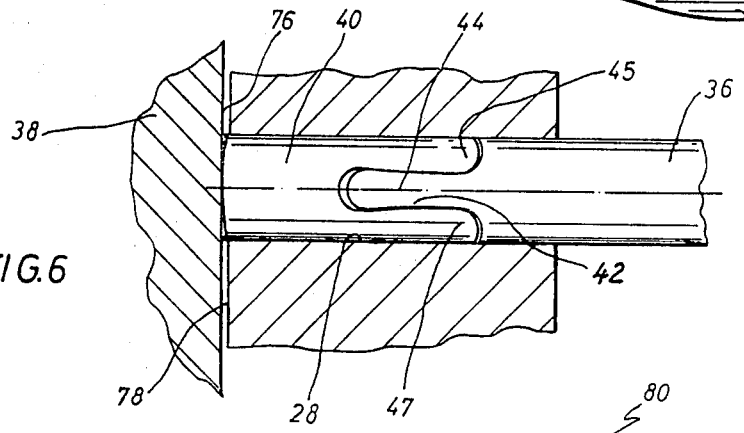

With reference particularly to FIG. 6, positioning of the female and male connector portions 42 and 44 of shafts 40 and 36 respectively within the bore or aperture 28 provide material enhancement of the structural integrity of the shaft interlock. In the event the opposed side portions of the female connector portion 42 tend to yield outwardly, the bore 28 functions in supporting relation to resist such yielding. The structural integrity of the interlock is therefore effectively supported and the shaft interlock will resist breakage or damage for extremely long periods of time. The configuration of the male and female connector elements of pivot shafts 36 and 40 is such that the shaft connection snaps into assembly by slightly yielding the opposed side portions 45 and 47 of the female connector. This yielding is quite within the limits of yielding allowed by the fit between the shafts 36 and 40 with the bore 28. This snap fit provides retention against axial separation of the shaft connection.

A sear pin 46 is positioned through registering apertures 30 and 32 and is formed to define an enlarged head portion 48 that is receivable within an enlarged portion 50 of the aperture 32 which cooperates with the aperture to define an annular shoulder 52. The annular shoulder 52 serves as a stop that is engaged by the head portion 48 of the sear pin 26 and which limits movement of the sear pin in one axial direction. As is evident in FIGS. 3 and 4, as well as FIG. 5, the right-handed safety device 34 at least partially overlies the head portion 48 of the sear pin 46 both in the safe and firing positions of the safety device. This feature maintains the sear pin against inadvertent disassembly from the frame structure of the gun.

As shown in detail in FIG. 5, the opposite extremity 54 of the sear pin 46 extends beyond the outer surface 56 of the frame 12. The sear pin 46 is also formed to define a safety interlock recess 58 that is positioned to receive the arcuate flange portion 60 of the left-handed safety device 38. The recess 58 and flange 60 cooperate to retain the left-handed safety device 38 against inadvertent separation from the frame structure of the gun by limiting outward movement of the right-handed safety device. The left-handed safety device is also formed to define a stop shoulder 62 at one extremity of the arcuate flange 60. Shoulder 62 engages the free extremity 54 of the sear pin 46 and limits pivotal movement of the left-handed safety device 38 at the firing position of the safety device. The left-handed safety device is also formed to define a stop surface 64 that engages a lower surface 66 of slide 18 to limit upward pivotal movement of the left-handed safety device such as shown in FIG. 1. The sear pin, therefore, in addition to serving its sear pin function, also serves to retain the left-handed safety device 38 in assembly with the frame of the gun structure and functions to stop the left-handed safety device in the firing position thereof.

As shown in FIGS. 3 and 4, the right-handed safety device 34 is capable of pivoting from a firing position shown in FIG. 3 to a safe position shown in FIG. 4. In the firing position, the upper locking corner 68 of the safety device remains clear of the locking detent 70 that is formed in the slide 18, thus allowing the slide freedom of rearward movement either manually during cartridge loading or automatically in response to gas energization during firing. In this position, the spring biased locking detent 72 is compressed, thus retaining the right-handed safety device 34 in the firing position thereof. As the right-handed safety device is moved upwardly to the safe position illustrated in FIG. 4, the locking corner 68 becomes received within the detent 70 and the spring urged detent 72 moves outwardly to follow the cam surface 74. The spring urged detent 72 functions to retain the safety device 34 either in the safe or firing position thereof.

ASSEMBLY

Where a handgun is employed, such as the Colt 0.45 caliber semi-automatic handgun, the conventional right-handed safety device will be disassembled from the gun and the sear pin will also be removed. This may be accomplished typically without the necessity of providing tools of any kind. Sear pin 46 then is inserted through registering apertures 30 and 32 to the position shown in FIG. 5, thereby positioning the head portion 48 of the sear pin within the enlarged outer portion 50 of the aperture 32. This also positions the recess or notch 58 of the sear pin in the exposed manner shown in FIG. 5 such that one side of the recess defined by the pin is positioned in substantially coplanar relation with surface 56 of the frame 12.

The left-handed safety device 38 is then brought into assembly with the frame 12 by inserting the shaft 40 through aperture 28 with the safety device misoriented with respect to the sear pin. When the shaft 40 has been inserted into the aperture sufficiently to bring the inner. surface of the safety device into engaging relation with the surface 56 of the frame, the safety device 38 is then rotated in such manner as to bring the arcuate flange 60 into enaging relation within the recess 58. To accomplish such positioning and rotation of the left-handed safety device 38, it is necessary that the slide 18 of the handgun be removed to prevent the slide from interfering with rotation of the safety device. After the slide had been inserted, the stop surface 64 will engage the lower surface 66 of the slide, thus stopping rotation of the left-handed safety device 38 sufficiently to disassemble the flange 60 from the flange receiving recess 58. As long as the slide 18 is in assembly with the handgun frame, it will not be possible to remove the left-handed safety device 38 from its movable connected relationship with the frame.

After the left-handed safety device 38 has been installed in the manner discussed above, the right-handed safety device than may be installed by inserting the pivot pin 36 through aperture 26 of the frame so as to bring the inner surface 76 of the right-handed safety device into engagement with the planar surface 78 of the frame. To accomplish this it is necessary that the right and left-handed safety devices be oriented in cooperating relationship, causing the pivot pins 36 and 40 thereof to be positioned such that the male and female connections 42 and 44 are disposed in receiving relationship. This causes a nonrotatable relationship to be developed between pivot pins 36 and 40 and thus causes both safety devices to move simultaneously between the safe and firing position upon movement of either the right or left-handed safety device.

Figure 7:
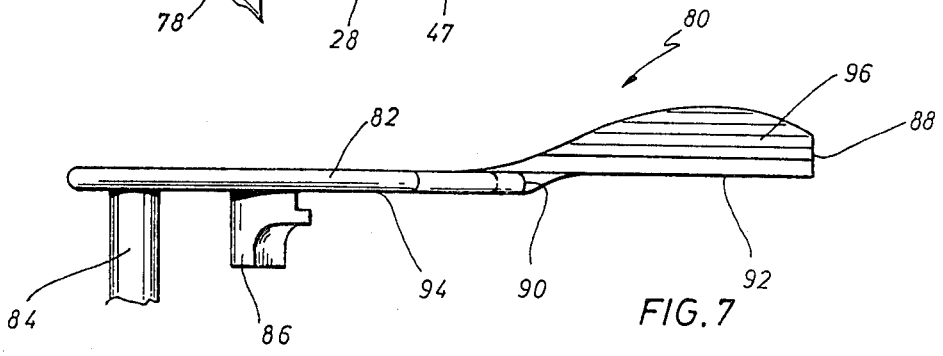

Referring now to FIG. 7, there is shown a handgun safety which is illustrated generally at 80 and which represents a modified embodiment of the present invention. As mentioned above, it is desirable to provide a safety mechanism that the user is capable of operating with the user's hand in substantially the proper gripping relation with the handgun. A safety of this character may conveniently takes the form illustrated in FIG. 7 where the safety incorporates a side plate 82 corresponding substantially to the configuration of the safety illustrated in FIGS. 3 and 4. A pivot shaft 84 extends from the side plate 82 and is adapted to be extended through registering bores of the handgun such as illustrated at 26 and 28 in FIG. 5. A safety interlock 86 also extends from the side plate 82 and is of the particular configuration required for proper interfitting relation with a safety interlock recess defined by the frame of the Colt semi-automatic handgun identified hereinabove.

To facilitate engagement of the safety of the handgun with the user's hand in substantially the gripping relation with the handgun, a safety actuation element 88 is shown to extend from the forward extremity 90 of the side plate 82. The safety actuation element 88 is offset with respect to the side plate 82 defining an inner surface 92 that is sufficiently offset with respect to the inner surface 94 of the side plate so as to pass freely over the side portion of the slide 18 as shown in FIG. 8. The safety actuation element 88 projects sufficiently forward of the forward extremity 90 of the side plate so that the grooved upper surface portion 96 thereof may be readily engageable by the last digit of the thumb of the user. When a safety mechanism such as shown in FIG. 7 is utilized in a military or law enforcement character, the safety may be actuated readily and rapidly so as to render the handgun usable without significant change in the grip of the user.

Figure 9:
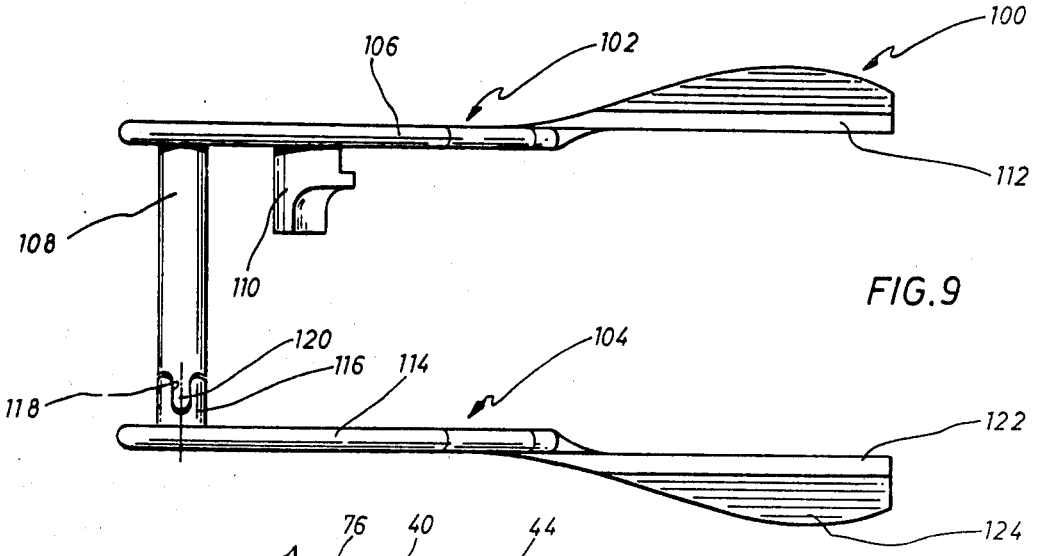

With reference now to FIG. 9, the extended safety mechanism structure of FIG. 7 may also be incorporated in an ambidextrous safety mechanism. FIG. 9 is a plan view of an ambidextrous safety mechanism constructed in accordance with this invention and representing a further modified embodiment. The safety mechanism illustrated generally at 100 incorporates a right-handed safety shown generally at 102 which enables a right-handed user to manipulate the safety with the thumb of the right hand. The ambidextrous safety mechanism also incorporates a left-handed safety illustrated generally at 104 which enables a left-handed user to operate the safety of the handgun with the thumb of the left hand in the same manner as described above in connection with FIGS. 1, 2 and 5. The right-handed safety 102 is constructed in similar manner as the safety illustrated in FIG. 7 with a side plate stucture 106 having a pivot pin 108 and safety interlock 110 projecting therefrom and adapted for interconnection with the handgun in the manner described above in connection with FIG. 7. Side plate 106 is also provided with an integral safety actuation element 112 extending from the forward portion thereof and usable in the same manner as described in connection with FIG. 7.

The left-handed safety element 104 incorporates a side plate structure 114 having a stub pivot shaft 116 extending therefrom. The pivot shaft 116 defines a female connector element 118 that is adapted to receive the male connector portion 120 of the pivot shaft 108 to thus interlock the shafts 108 and 116 in the same manner as discussed above in connection with FIG. 6. Again, the left-handed safety is provided with a safety actuation element 122 that extends from the forward portion of the side plate 114 and defines a grooved upper surface 124 that is engageable by the last digit of the thumb of a left-handed user to provide for simple and quick actuation of the safety to the firing position thereof while the hand of the user is in substantially the proper gripping relationship with the handgun.

In view of the foregoing, it is apparent that I have provided a novel safety system for guns such as handguns, rifles, shotguns, etc., which may be simply and efficiently utilized by right-handed or left-handed users. The safety system of the present invention may be provided in kit form for replacement of conventional right-handed safety devices for guns or, in the alternative, may be assembled to such guns as original equipment.

The novel safety system of this invention utilizes a unique separatable but driving relationship between shafts that extend from each of the right and left-handed safety devices. Additionally, a sear pin is employed that is retained in proper position with the frame of the gun by one of the safety devices and which functions to retain the opposite one of the safety devices in movable assembly with the structure of the gun. It is therefore seen that this invention is one well adapted to attain all of the objects and advantages hereinabove set forth, together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth and shown in the accompanying drawings are to be interpreted as illustrative and not in a limiting sense.

Having thus fully described and illustrated this invention,

I claim:

1. An ambidextrous safety system for guns wherein such guns are adapted for efficient use by both right and left-handed users, and the guns incorporate a frame defining pivot bore means, said safety system comprising:

a right-hand safety means having first pivot shaft means extending into said pivot bore means;

left-hand safety means having second pivot shaft means extending into said pivot bore means;

connection means establishing nonrotatable relation between said first and second pivot shaft means, in the assembled relation of said first and second shaft means said connection means being positioned within said pivot bore means and said pivot bore means providing structural support for said connection means;

pin means extending through registering shaft apertures in the frame of said gun, said pin means having movable interlocking relation with said left-hand safety means to retain said left-hand safety means in assembly with said handgun.

2. An ambidextrous safety system for guns as recited in claim 1, wherein said connection means comprises:

a female drive connection being formed on one of said first and second shaft means;

a male drive connection being formed on the other of said first and second shaft means and mating with said female drive connection to define said nonrotatable relation between said first and second shaft means and causing said right and left-hand safety means to have simultaneous locking and unlocking movement upon movement of either of said right and left-hand safety means; and said pivot bore means restraining spreading of said female drive connection.

3. An ambidextrous safety system for guns as recited in claim 1, wherein:

said pin is formed to define first locking means and said left-hand safety means is formed to define second locking means, said first and second locking means cooperating to retain said left-hand safety means in assembly with said frame of said gun.

4. An ambidextrous safety system for guns as recited in claim 3, wherein:

said first locking means is a groove defined in said pin, and said second locking means is a flange formed on said left hand safety means, said flange being engaged with said groove of said pin and retains said left hand safety in assembly with said frame of said gun.

5. An ambidextrous safety system for guns as recited in claim 1, wherein:

said pin means retains the sear of said gun.

6. An ambidextrous safety system for guns as recited in claim 1, wherein:

said right hand safety means replaces the conventional right hand safety means of said gun;

said left hand safety means is received within the pivot bore means of said gun; and said pin means replaces the sear pin of said gun and retains the sear of said gun;

said right hand safety means, said left hand safety means and said pin means are assembled to the frame of said gun without modification of the frame in any manner.

7. An ambidextrous safety system for a handgun as recited in claim 1, wherein:

said right hand safety means retains the sear pin means in assembly with said frame of said handgun.

8. An ambidextrous safety system for a handgun as recited in claim 1, wherein:

said sear pin means defines a stop for limiting movement of said left-hand safety means and positions said left-hand safety means at the firing position of said safety system.

9. An ambidextrous safety system for a handgun as recited in claim 8, wherein:

said left-hand safety means is formed to define stop surface means, said stop surface means engaging a structural element of said handgun to limit movement of said left-hand safety means and positioning said left-hand safety means at the safe position of said safety system.

10. An ambidextrous safety system for a handgun that converts such handgun for efficient use by both right- and left-handed users wherein said handgun incorporates a frame having opposed safety shaft bores formed therein, said safety system comprising:

right-handed safety means having first shaft means extending through at least one of the safety shaft bores in the frame of said handgun;

left-hand safety means having second shaft means extending through at least one of said safety shaft bores in the frame of said handgun;

female connection means being formed on one of said first and second shaft means and male connection means being formed on the other of said first and second shaft means, said male and female connection means interengaging and establishing a nonrotatable relation therebetween, said male and female connection means being positioned within one of said safety shaft bores in the assembled relation thereof to said frame of said handgun; and sear pin means replacing the sear pin of said handgun and extending through registering sear pin apertures in the frame of said handgun and retaining the sear of said handgun, said sear pin means having movable interlocking relation with said left-hand safety means retaining said left-hand safety means in movable assembly with the frame of said handgun.

11. An ambidextrous safety system for a handgun as recited in claim 10, wherein:

said right-hand safety means retains said sear pin means against disassembly from said handgun.

12. An ambidextrous safety system for a handgun as recited in claim 10, wherein:

said sear pin means defines a free extremity positioned outwardly of the frame of said handgun, said free extremity of said sear pin being formed to define a safety retaining groove; and said right-hand safety means defining flange means, said flange means being positioned within said groove of said sear pin and establishing a movable interlocking; relation between said sear pin and said left-hand safety means and retaining said left-hand safety means in movable assembly with said frame.

13. An ambidextrous safety system for a handgun as recited in claim 10, wherein:

said right-hand safety means retains the sear pin means in assembly with said frame of said handgun.

14. An ambidextrous safety system for a handgun as recited in claim 10, wherein:

said sear pin means defines a stop for limiting movement of said left-hand safety means and positioning said left-hand safety means at the firing position of the safety system.

15. An ambidextrous safety system for a handgun as recited in claim 14, wherein:

said left-hand safety means defines stop surface means, said stop surface means engaging a structural element of said handgun to limit movement of said left-hand safety means and positioning said left-hand safety means at the safe position of said safety system.

16. A thumb actuatable safety mechanism for handguns having a frame structure defining opposed pivot bores and having a reciprocating slide for semi-automatic actuation, said safety mechanism comprising:

a pair of side plates;

pivot shaft means extending from one side of each of said side plates and extending through said opposed pivot bores, said side plates being pivotal about an axis defined by said pivot shaft means;

a nonrotatable snap retention fit tongue-in-groove joint connection defined by said pivot shaft means of each side plates said joint connection being positioned within one of said pivot bores, said one pivot bore providing structural support for said nonrotatable snap retention fit tongue-in-groove joint, connection; and safety actuation means extending from said forward portion of said side plates and being positioned for engagement by the first digit of the user's shooting hand for pivot actuation of said side plates to the firing and safe positions thereof.

17. A thumb actuatable safety mechanism as recited in claim 16, wherein:

said safety actuation means is formed integrally with said side plates and is formed to define an offset allowing said safety actuation means to move past said slide upon pivoting of said side plates.

18. A thumb actuatable safety mechanism as recited in claim 16, wherein said snap retention fit tongue-in-groove joint connection comprises:

a first bifurcated connection element defining a pair of spaced side legs and having a central receptacle between said side legs; and a second connection element being formed to define a central locking projection being received in snap fitting relation within said central receptacle and establishing nonrotatable connection between said shaft elements, said first and second connection elements establishing a snap retention fit therebetween.

* * * * *